US005178916A

United States Patent [19]

Chidsey et al.

[11] Patent Number: 5,178,916

[45] Date of Patent: Jan. 12, 1993

[54] PROCESS FOR MAKING CORROSION-RESISTANT ARTICLES

[75] Inventors: Christopher E. D. Chidsey, North Plainfield; Henry H. Law, Berkeley Heights, both of N.J.

[73] Assignee: AT&T Bell Laboratories, Murray Hill, N.J.

[21] Appl. No.: 760,839

[22] Filed: Sep. 16, 1991

Related U.S. Application Data

[63] Continuation-in-part of Ser. No. 718,890, Jun. 21, 1991, abandoned.

[51] Int. Cl.[5] ..... B05D 3/04

[52] U.S. Cl. ..... 427/343; 427/404; 427/419.1; 427/430.1

[58] Field of Search ..... 427/436, 343, 131, 404; 428/695, 419.1, 900, 430.1

[56] References Cited

U.S. PATENT DOCUMENTS

| | | | |
|---|---|---|---|
| 3,900,370 | 8/1975 | Gunther et al. | 204/38 A |
| 4,425,404 | 1/1984 | Suzuki | 428/341 |
| 4,518,627 | 5/1985 | Foley | 427/48 |
| 4,526,837 | 8/1981 | Ohtsuki | 428/425.9 |
| 4,701,375 | 10/1987 | Nishimatsu | 428/336 |
| 4,729,924 | 3/1988 | Skorjanec | 428/422 |
| 4,794,042 | 12/1988 | Kubota | 428/328 |
| 4,868,046 | 9/1989 | Moriizumi et al. | 428/323 |
| 4,886,703 | 12/1989 | Hasumi et al. | 428/323 |
| 4,927,716 | 5/1990 | Goulding | 428/695 |
| 4,952,444 | 8/1990 | Kawamata et al. | 428/141 |

OTHER PUBLICATIONS

*Plating and Surface Finishing*, 76(4), 1989, "Nickel--Phosphorus Alloy As a Low-Cost Electrical Contact Material", C. A. Holden, H. H. Law, C. A. Mattoe and J. Sapjeta, pp. 58–61.

*Primary Examiner*—Bernard Pianalto

*Attorney, Agent, or Firm*—Martin I. Finston; Eugen E. Pacher

[57] ABSTRACT

Transition-metal-coated metallic elements, such as electrical contacts, are protected from corrosion by a novel surface treatment. In one embodiment, the treatment involves application of a phosphonate solution, optionally preceded by application of a chromatic solution phosphonate.

17 Claims, 6 Drawing Sheets

PROCESS FOR MAKING CORROSION-RESISTANT ARTICLES

This application is a continuation-in-part of application Ser. No. 07/718,890 filed on Jun. 21, 1991, abandoned.

FIELD OF THE INVENTION

The invention concerns the field of surface treatments for protecting metal objects from corrosion, and more specifically, for protecting nickel-plated metallic elements such as electrical contacts.

ART BACKGROUND

For reasons of economy, some nickel-plated electrical contacts in commercial use have gold platings (over the nickel) that are relatively thin, i.e., 0.1–0.25 μm in thickness. However, such thin gold layers are generally porous, and in order to prevent corrosion and tarnishing, a further protective surface treatment is required. Chromate treatment appears to inhibit corrosion to some extent. However, where the gold overplating is absent or is very thin (i.e., no more than about 0.1 μm thick), chromate treatment alone often provides inadequate surface protection. Practitioners have hitherto been unable to provide a surface treatment that supplements, or replaces, chromate treatment, and that can give adequate protection to treated surfaces without substantially increasing their contact resistance. This application describes such a treatment.

SUMMARY OF THE INVENTION

In a broad sense, the invention involves a method for manufacturing a plurality of metallic articles that have improved resistance to corrosion. Each such article comprises at least one metallic element such as an electrical contact. At least a portion of the element is coated, e.g., plated, with nickel, or a nickel alloy, or another transition metal such that the resulting coating has an external surface. The method includes the step of exposing the external surface to a liquid solution of a phosphonate or similar compound, resulting in increased resistance of the coating to corrosion, compared to an article that is not so treated. (In some instances, the transition metal coating is, prior to the phosphonate treatment, overcoated with a noble metal such as gold. In such cases, the relevant external surface is the external surface of the noble metal overcoating.)

Resistance to corrosion is conventionally measured in various ways. For at least some applications, particularly in the electrical and electronics industry, resistance to corrosion is described by reference to the electrical contact resistance associated with the external surface of the coating.

Thus, in order to demonstrate the efficacy of the phosphonate treatment, articles processed according to the invention may be subjected to a predetermined aging process, and the contact resistances may then be measured. For a given set of coating properties, well known statistical methods are used to derive from such tests the expected fraction of articles that will survive the aging process. Generally, an article is regarded as "surviving" if the contact resistance, after aging, is less than a predetermined threshold. A typical such threshold, for some applications, is 50 milliohms. A typical aging process involves exposure to the Battelle mixed gas environment, described below. Exposure to such an environment is typically for a duration of 24 hours, although reduced exposures, such as 8-hour exposures, are also useful for some applications.

DETAILED DESCRIPTION

Figure 1:
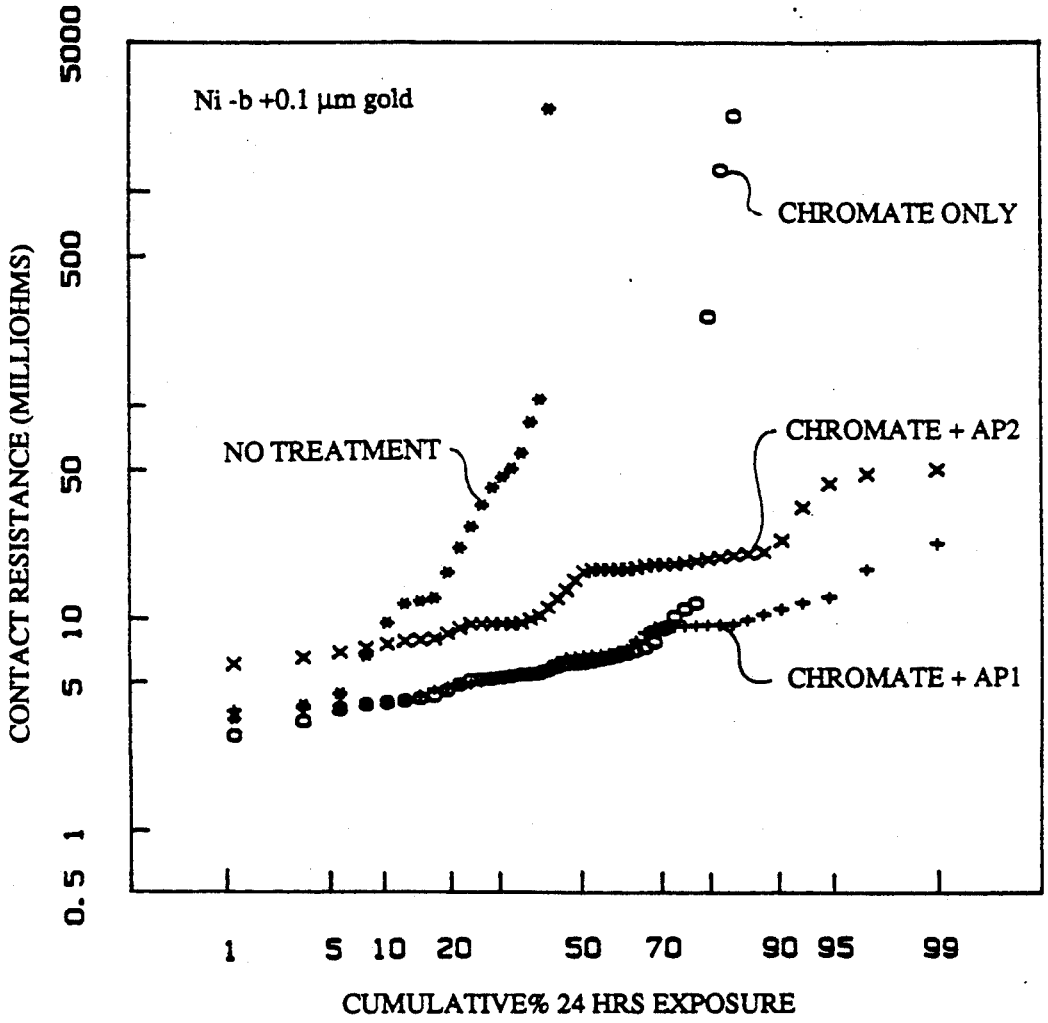
FIG. 1 is a statistical plot showing the effect of an aging process on the contact resistances of nickel samples which have a thin gold overcoating and which also have, respectively, no surface treatment, chromate treatment only, and chromate treatment plus phosphonate treatment.

As noted, it is a widespread practice in the electronics industry to provide nickel-plated, or nickel-alloy-plated electrical contacts that are overcoated with a noble metal layer, e.g., a gold layer about 0.6–0.75 μm thick. (Hereafter, "nickel-plated" will refer to those workpieces that are plated with a nickel alloy, as well as those that are plated with substantially pure nickel.) The inventive method is not limited to workpieces having such relatively thick gold overcoatings, but makes possible the use of (for the sake of highly desirable economic advantages) nickel-plated workpieces that have a gold overcoating less than about 0.6 μm thick, and even workpieces that have no gold overcoating at all. According to a currently preferred embodiment, the method is practiced on a nickel-coated workpiece having a gold overcoating about 0.1 μm thick. A relevant nickel coating is formed, e.g., by standard plating methods, or, alternatively, by sputtering or evaporative deposition.

It should be noted in this regard that according to our current understanding, the inventive method is not limited to nickel-containing coatings, but is usefully employed to protect metal coatings that comprise other transition metals, such as cobalt, titanium, chromium, and iron. Specifically, the phosphonates and similar compounds of the inventive method are capable of forming insoluble salts with most or all of the high-valency transition metals. We believe that the inventive method is usefully employed to protect the surface of any such metal that can form such insoluble salts.

It should further be noted that the inventive method is usefully employed to protect transition metal coatings that are overcoated with noble metals other than, or in combination with, gold. Such alternative noble metals include, e.g., platinum and palladium.

The workpiece is optionally exposed to a chromate solution before it is exposed to the phosphonate solution. The chromate-exposing step is currently preferred because it is believed that the combined chromate and phosphonate treatments produce greater resistance to corrosion than either treatment alone.

According to an exemplary chromate treatment, each workpiece is immersed for one minute in a boiling aqueous solution composed essentially of water, chromic acid, 4 g/L; nitric acid, 2 g/L; and sulfuric acid, 0.5 g/L. After immersion, the workpieces are retrieved, rinsed in deionized water, and dried in a flow of compressed air.

According to an exemplary phosphonate treatment, each workpiece is soaked in an appropriate, room-temperature solution for a period of time sufficient to establish a steady state as detected, e.g., by cyclic voltammetry. ("Phosphonate treatment" is intended herein to denote treatment by any of various phosphonic acids, phosphonate salts, and similar compounds described in more detail below.) A currently preferred duration for the soaking step is about 15 minutes. The soaking step is followed by rinsing with deionized water and air drying. The appropriate solution consists essentially of a 1–10 millimolar solution of a desired phosphonate (or similar compound) in a non-corrosive solvent capable of achieving the desired concentration. A currently preferred solvent is an alcohol such as ethanol. However, other solvents are also readily employed. (For some applications, in fact, the solution is advantageously applied in a contact lubricant. In such cases, an appropriate solvent is, e.g., a wax, fine oil, or detergent.) As a result of such treatment, it is believed that an adsorbed layer of, e.g., phosphonate is formed on the treated surface. It is currently believed that such a layer is a monolayer, although a fractional or multiple layer may be formed in at least some cases.

Appropriate compounds for use in the phosphonate treatment include phosphonic acids and their salts (e.g., sodium or potassium phosphonates), and monoesters of phosphoric acid and their salts.

A currently preferred compound for the phosphonate treatment is a phosphonic acid, here designated "AP1", which has the formula $C_8F_{17}SO_2N(CH_2CH_3)C_2H_4PO(OH)_2$. A preferred solution of AP1 is 4 millimolar in ethanol. An alternative phosphonic acid, here designated "AP2", has the formula $CF_3(CF_2)_{11}(CH_2)_2PO(OH)_2$. A preferred solution of AP2 is 2 millimolar in ethanol.

Although, as noted, a currently preferred compound is AP1, the method is usefully practiced with any of a broad range of phosphonic acids and related compounds. In this regard, it is desirable to select a compound whose molecular structure includes at least about six fluorinated carbon atoms. It is believed that in an adsorbed layer, molecules satisfying this criterion will exhibit desirable cohesion, and will cover the substrate surface completely enough to offer a useful amount of protection. In this regard, at least partial fluorination is desirable. As a general rule, within a given class of phosphonates differing only in the degree of fluorination, the desirability of the phosphonate increases with the degree of fluorination.

More specifically, it is desirable to select a partially fluorinated alkyl phosphonic acid, having at least about 6, but not more than about 14, perfluorinated carbon atoms. Molecules having substantially more than 14 carbon atoms are undesirable because they are generally difficult to dissolve and (because of low volatility) difficult to purify by distillation.

It may also be desirable to select a molecule having multiple hydrocarbon chains, because these are likely to provide protection at lower phosphonate coverage of the treated surface.

As noted, monoesters of phosphoric acid (i.e., phosphate monoesters) and their salts are useful as alternatives to phosphonic acids and related compounds. The phosphonic acid functional group is structurally very similar to the functional group of phosphate monoesters. On that basis, it is expected that the transition metal binding properties of both classes of compounds are also similar. As with phosphonic acids, it is desirable to select a phosphate monoester that is at least partially fluorinated, or that includes multiple hydrocarbon chains.

One exemplary class of phosphate monoesters that are useful for the practice of the inventive method are the phosphatidic acids having the formula $$\begin{array}{l} H_2O_3POCH_2CH{-}OC(O)(CH_2)_nCH_3 \\ \qquad\qquad\quad | \\ \qquad\qquad\quad CH_2{-}OC(O)(CH_2)_nCH_3, \end{array}$$

where n is an integer lying in the range 10–16. As noted, the salts, e.g., sodium or potassium salts, of these acids are also useful for practicing the inventive method.

According to our current understanding, a useful phosphatidic acid treatment includes the step of soaking each workpiece for, e.g., 15 minutes in a 1 millimolar solution of one of the above-identified phosphatidic acids in chloroform at room temperature. The soaking step is followed by rinsing with deionized water and air drying. As a result of such treatment, it is believed that an adsorbed, protective layer is formed on the treated surface. The phosphatidic acid treatment is optionally preceded by a chromate treatment.

EXAMPLE 1

Experimental evaluation of the inventive method was carried out on brass coupons 0.5 in. (1.27 cm) by 2.0 in. (5.08 cm) in size. Each coupon was plated with a 2.5-μm thickness of bright nickel (Ni-b) from a standard nickel sulfamate bath, followed by a 0.1-μm thickness of gold. Selected samples were subjected to an AP1 or AP2 treatment substantially as described above. Prior to the phosphonate treatment, some samples were subjected to a chromatic treatment, substantially as described above.

Contact resistance to each sample was measured with a 50-g applied load. Contact was to a 0.5-mm-diameter high-purity gold wire. The contact resistance was measured using a Keithley Model 580 micro-ohmmeter under the dry circuit test mode with a maximum voltage of 20 mV.

The samples were subjected to an aging process which consisted of exposure for 24 hours in air containing, nominally, 10 ppb chlorine, 10 ppb hydrogen sulfide, and 200 ppb nitrogen dioxide. The aging environment was held at a constant temperature of 30° C. and a constant relative humidity of 70%. This environment is hereafter referred to as the "Battelle Class II mixed gas environment."

The following are the measured contact resistances for the samples after aging: Of the untreated samples, about 30% had resistances less than 50 milliohms. (A threshold of 50 milliohms for accepting or rejecting an electrical contact is typical in at least some applications.) Of the samples treated with chromate only, about 80% had resistances less than 50 milliohms. Of the samples treated with chromate followed by AP1 or AP2, all had resistance values less than 50 milliohms. These results are illustrated in FIG. 1.

EXAMPLE II

As in Example I, experimental evaluation of the inventive method was carried out on brass coupons 0.5 in. (1.27 cm) by 2.0 in. (5.08 cm) in size. Each coupon was plated with a 2.5-μm thickness of nickel, followed by a 0.1-μm thickness of gold. Two different processes for nickel deposition were used. On some coupons, bright nickel (Ni-b) was deposited from a standard nickel sulfamate bath. On other coupons, gray nickel alloy (Ni-g) containing less than 2 at. % phosphorus was deposited from a neutral ammoniacal bath. The process for depositing the Ni-g alloy is described in C. A. Holden, et al., *Plating and Surf. Finish.* 76(4), 58 (1989). Each sample was subjected to an AP1 or AP2 treatment substantially as described above. Prior to the phosphonate treatment, some samples were subjected to a chromate treatment, substantially as described above.

Contact resistance to each sample was measured as described above.

Some of the samples were subjected to an aging process which consisted of exposure for 24 hours in a Battelle Class II mixed gas environment.

Figure 2:
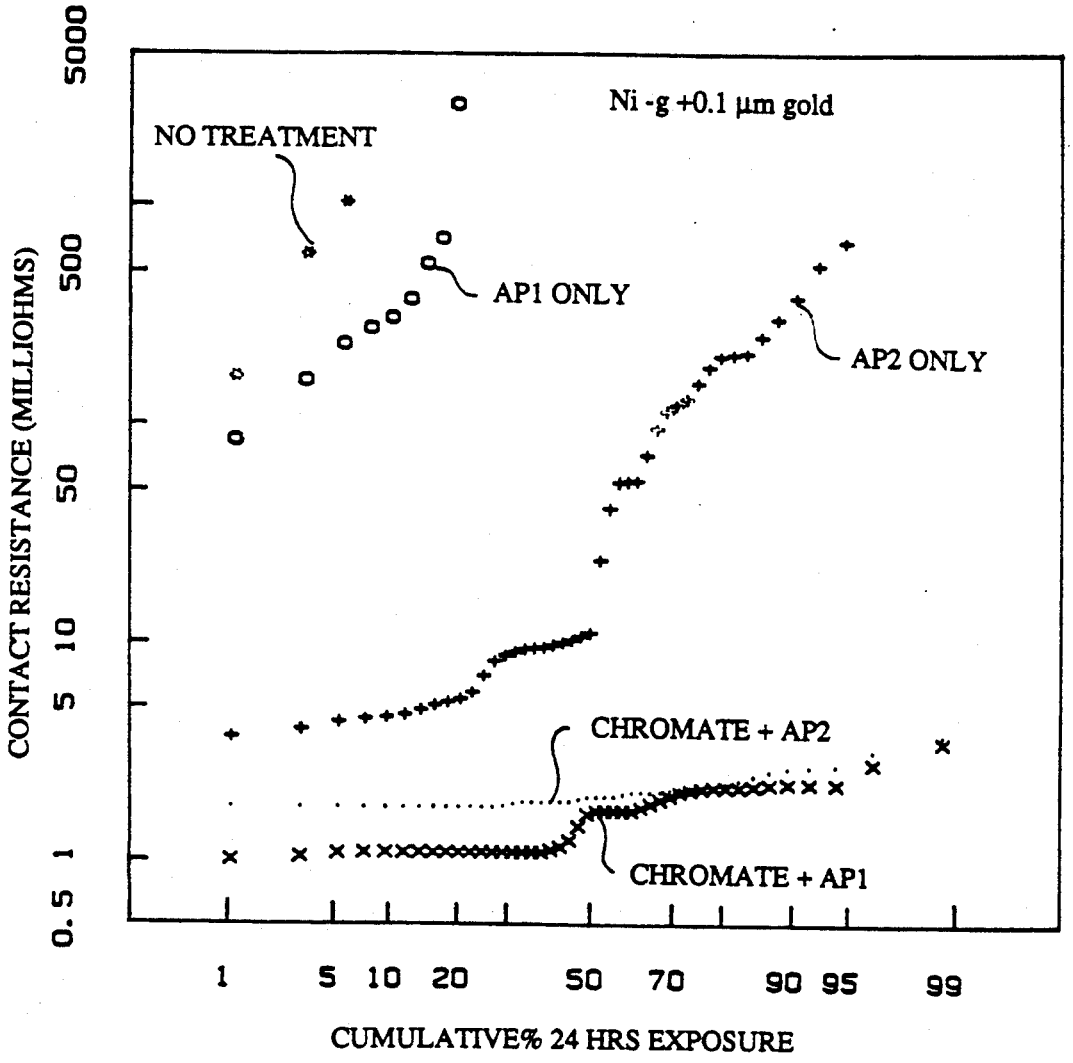
FIG. 2 is a statistical plot showing the effect of an aging process on the contact resistances of nickel-alloy samples which have a thin gold overcoating and which also have, respectively, no surface treatment, phosphonate treatment only, and chromate treatment plus phosphonate treatment.

The following are the measured contact resistances for the Ni-g samples after aging: For untreated samples, all measurements were 50 milliohms or more. For samples treated with AP1 only, all measurements were 50 milliohms or more, and thus there was only a slight improvement relative to the untreated samples. However, of the samples treated with AP2 only, about 15% exhibited resistance less than 5 milliohms, about 40% exhibited resistance in the range 5–50 milliohms, and only about 45% exhibited resistance greater than 50 milliohms. For samples treated with chromate followed by AP1 or AP2, all measurements were less than 5 milliohms. The Ni-g statistical results are illustrated in FIG. 2.

Figure 3:
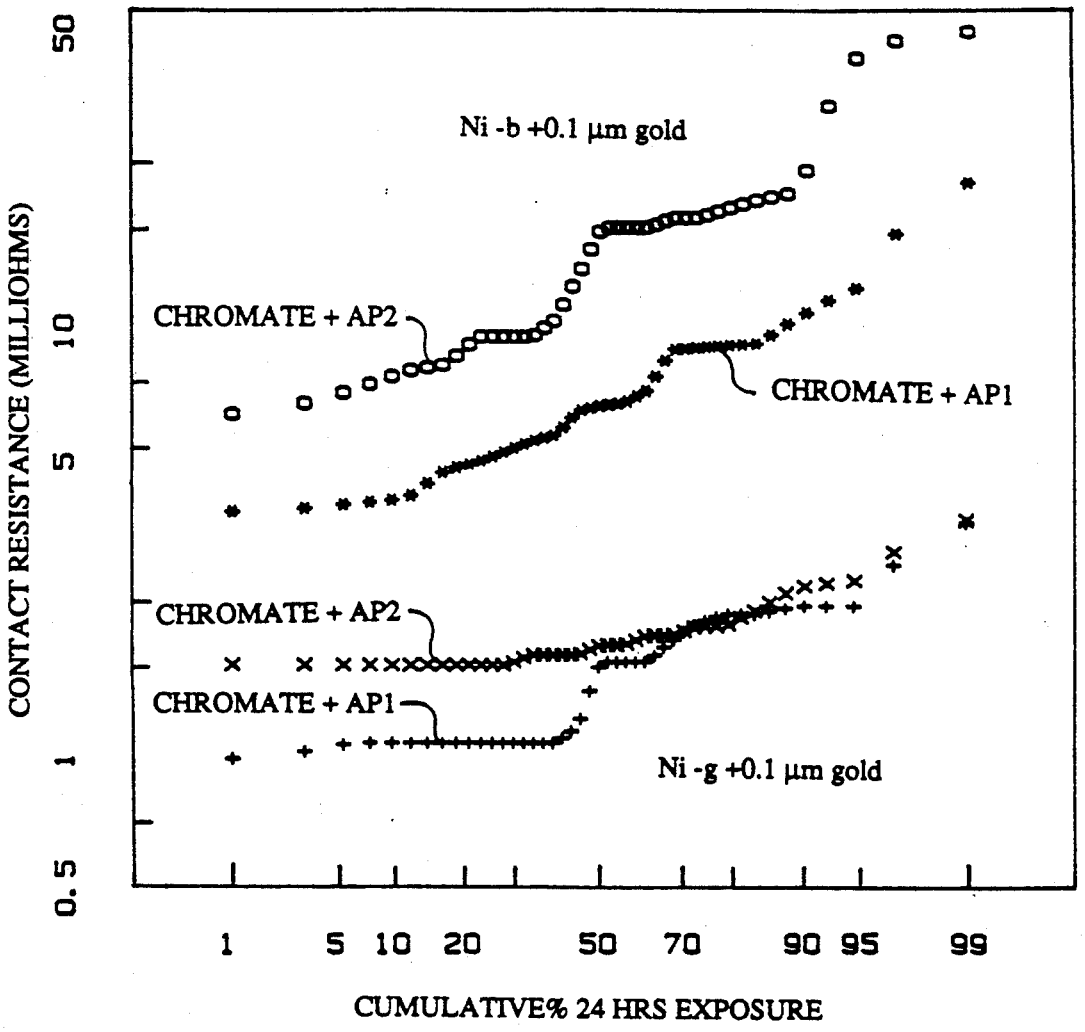
FIG. 3 is a statistical plot showing the effect of an aging process on the contact resistances of nickel and nickel-alloy samples which have a thin, gold overcoating and which have also been treated with chromate plus a phosphonic acid.

The following are the measured contact resistances for chromated Ni-b samples after aging: with AP1 or AP2 treatment, all measurements were less than 50 milliohms; without phosphonate treatment, 80% of the measurements were less than 50 milliohms. The Ni-g statistical results are compared with the Ni-b results in FIG. 3.

EXAMPLE III

Samples were prepared substantially as in Example II, but without chromate and without any gold overcoating. Cyclic voltammetry was performed on the samples using an EG&G Princeton Applied Research Model 173 potentiostat. The electrolyte was 0.1 molar $Na_2SO_4$. The sample was used as the working electrode, a platinum wire was used as the counter electrode, and the reference electrode was saturated calomel. The sweep rate was 20 mV/second.

The cyclic voltammograms of AP1-treated Ni-b samples showed larger anodic currents than those of AP2-treated Ni-b samples. The cyclic voltammograms of the Ni-g samples showed substantially no electrochemical activity for AP1-treated or for AP2-treated samples.

Figure 4:
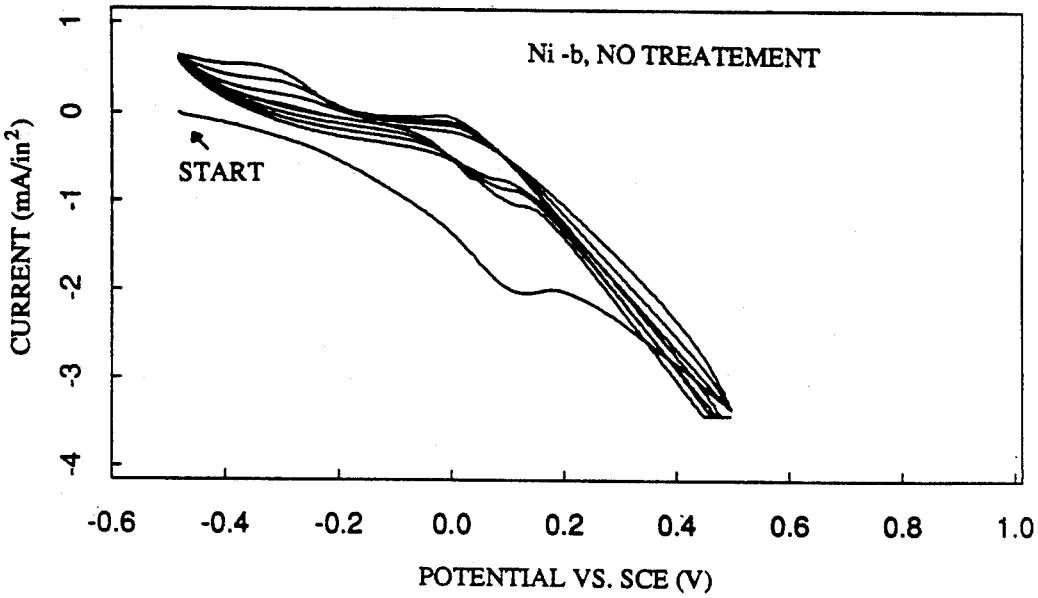
FIG. 4 is an exemplary cyclic voltammogram of an untreated nickel sample.
Figure 5:
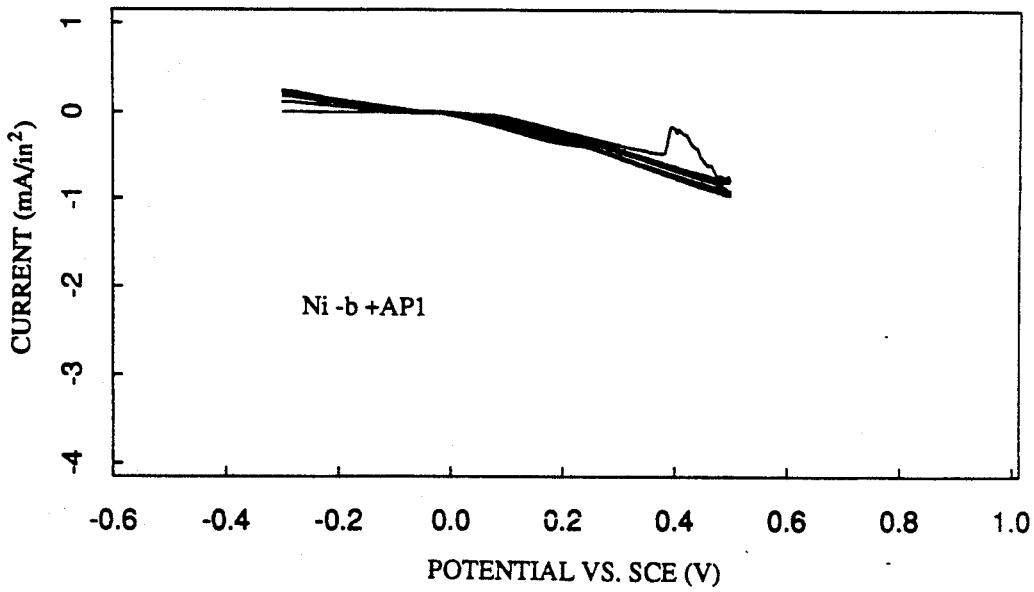
FIG. 5 is an exemplary cyclic voltammogram of a nickel sample that has been treated with a phosphonic acid.

FIG. 4 shows an exemplary cyclic voltammogram of a Ni-b sample without phosphonate treatment. FIG. 5 shows an exemplary cyclic voltammogram of a Ni-b sample treated with AP1.

These results suggest that phosphonate treatment is capable of providing at least some protection to a nickel (or nickel-alloy) surface even when the surface has been neither chromated nor gold plated.

EXAMPLE IV

Figure 6:
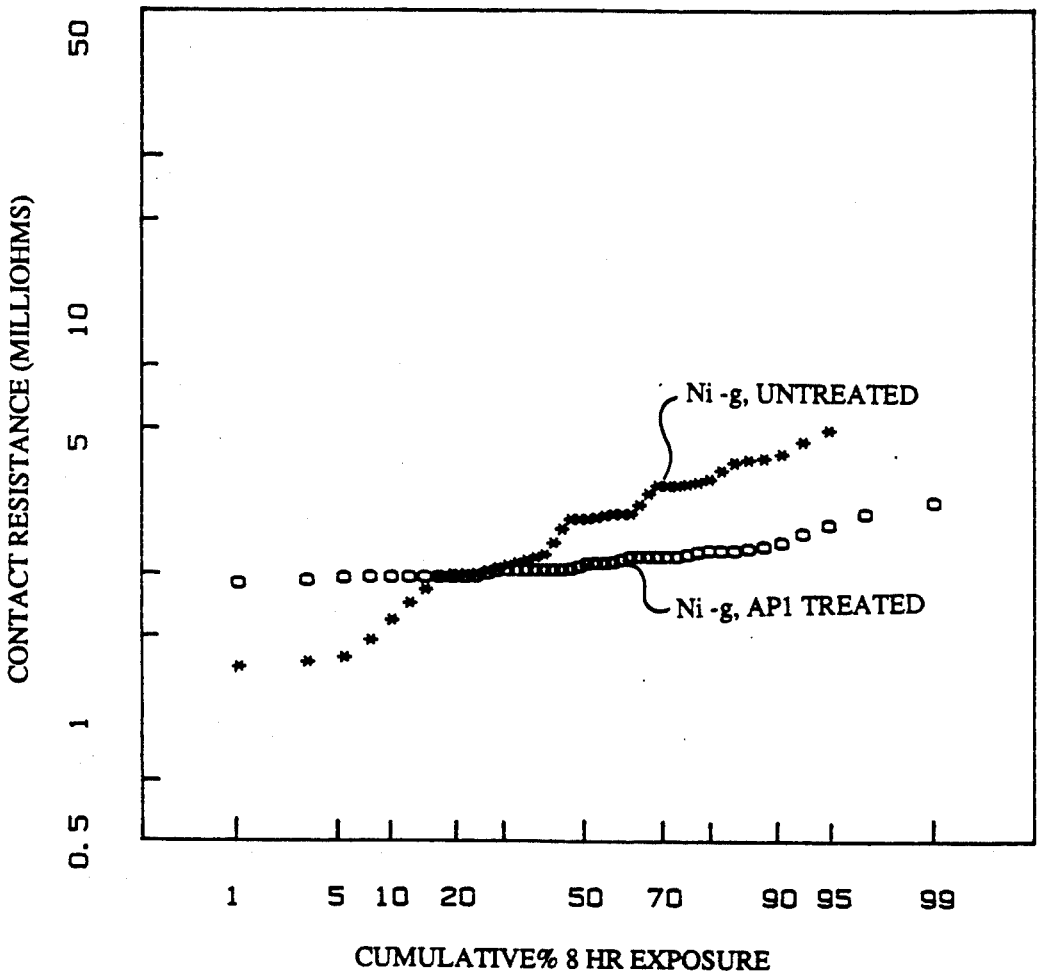
FIG. 6 is a statistical plot showing the effect of a shortened aging process on the contact resistances of nickel-alloy samples which are, respectively, untreated, and treated with a phosphonic acid.

Samples of Ni-g were prepared substantially as in Example II, but without chromate and without any gold overcoating. The samples were treated with AP1 as described above. After aging of a selected sample for 24 hours in the mixed gas environment of Example II, the surface of the sample was found to be covered by an insulating nickel salt. However, after a reduced again period of only 8 hours, a group of samples displayed, in general, a substantial reduction of contact resistance, relative to a group of untreated samples. FIG. 6 is a statistical plot of this result. It is apparent from FIG. 6 that more than 50% of the untreated samples had contact resistances greater than 3 milliohms, whereas only about 10% of the treated samples had contact resistances greater than 3 milliohms.

This result suggests that phosphonate treatment without chromate treatment, and with little or no gold overcoating, can provide adequate protection for electrical contacts on low-cost components that are intended for use in benign environments or that are intended to have a relatively short replacement interval.

Figure 7:
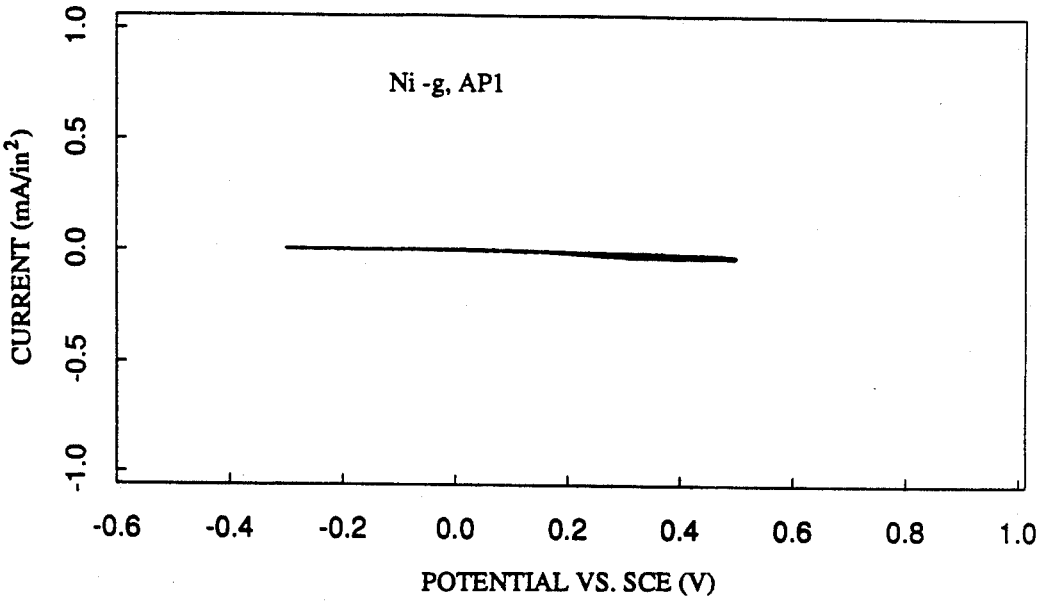
FIG. 7 is an exemplary cyclic voltammogram of a nickel-alloy sample that has been treated with a phosphonic acid.

Such a conclusion is supported by the result of Example III that a cyclic voltammogram of AP1-treated Ni-g showed substantially no electrochemical activity. The cyclic voltammogram is shown in FIG. 7.

As discussed above, one useful phosphonic acid, here denoted "AP2," has the formula $CF_3(CF_2)_{11}(CH_2)_2PO(OH)_2$. This compound is a member of a class of phosphonic acids having the general formula $CF_3(CF_2)_m(CH_2)_nPO(OH)_2$; m=5, 7, 9, 11; n=0, 1, 2. (AP2 corresponds to the case m=11, n=2.)

According to our current understanding, any compound selected from this class will be useful, not only for the metal-protective application described above, but also as a contact lubricant for surfaces of bodies which comprise transition metals, transition metal alloys such as ferrous alloys, or aluminum-containing alloys. In particular, compounds of this class are believed useful for lubricating the interfaces between magnetic disks used for the digital storage of information and the heads used for reading such information.

Various methods of application will be useful for lubricative purposes. Exemplary application is by the soaking method described above. Alternative application is as a trace component in a fluid carrier. Such a carrier is, for example, a wax, fine oil, or detergent. Another possible carrier, particularly for the lubrication of internal combustion engines, is motor oil.

We claim:

1. A method for manufacturing a first plurality of metal-coated articles, wherein:

each of said articles has a chemically modified external surface and a contact resistance associated with the external surface;

associated with the coatings is a resistance to corrosion defined as the expected fraction of articles exhibiting contact resistances below a predetermined threshold after being subjected to a predetermined aging process;

the method comprises the steps of:

a) providing a first plurality of metal workpieces, each workpiece comprising a metal substrate and, formed on the substrate, a metal coating which has an external surface, wherein the metal coating comprises a transition metal selected from the group consisting of nickel, cobalt, titanium, chromium, and iron; and b) exposing each of said coating external surfaces to a liquid solution of a chemical compound selected from the group consisting of those phosphonic acids, and the salts thereof, which include at least 6 carbon atoms, resulting in a chemically modified coating external surface; and the exposing step is carried out such that: i) each of said modified surfaces has a contact resistance of about 50 mΩ or less; and ii) the resistance of the first plurality of articles to corrosion is increased, as compared to a second plurality of articles nominally identical to the first plurality but not exposed to such a liquid solution.

2. The method of claim 1, wherein the transition metal is nickel.

3. The method of claim 1, wherein the chemical compound is at least partially fluorinated.

4. The method of claim 1, wherein the molecular structure of the chemical compound includes multiple hydrocarbon chains.

5. The method of claim 1, wherein the molecular structure of the chemical compound includes at least 6 fluorinated carbon atoms.

6. The method of claim 1, wherein the chemical compound is a partially fluorinated alkyl phosphonic acid including at least about 6, but not more than about 14, perfluorinated carbon atoms.

7. The method of claim 6, wherein the phosphonic acid has the formula $C_8F_{17}SO_2N(CH_2CH_3)C_2H_4PO(OH)_2$.

8. The method of claim 6, wherein the phosphonic acid has the formula $CF_3(CF_2)_{11}(CH_2)_2PO(OH)_2$.

9. The method of claim 1, wherein each of said metal coatings further comprises a noble metal layer overlying the transition metal coating, and each said coating external surface is the surface of the corresponding noble metal layer distal the transition metal coating.

10. The method of claim 9, wherein each of said noble metal layers is a gold layer.

11. The method of claim 10, wherein each gold layer is less than about 0.6 μm thick.

12. The method of claim 10, wherein each gold layer is no more than about 0.1 μm thick.

13. The method of claim 1, further comprising, before the chemical-compound-exposing step, the step of exposing each said coating external surface to a chromate solution such that the resistance to corrosion is further increased.

14. A method for manufacturing a first plurality of metal-coated articles, wherein:

each of said articles has a chemically modified external surface and a contact resistance associated with the external surface;

associated with the coatings is a resistance to corrosion defined as the expected fraction of articles exhibiting contact resistances below a predetermined threshold after being subjected to a predetermined aging process;

the method comprises the steps of:

a) providing a first plurality of metal workpieces, each workpiece comprising a metal substrate and, formed on the substrate, a metal coating which has an external surface, wherein the metal coating comprises nickel or a nickel alloy;

b) exposing each of said coating external surfaces to a chromate solution; and c) then exposing each of said coating external surfaces to a liquid solution of a partially fluorinated alkyl phosphonic acid which includes at least about 6, but not more than about 14, perfluorinated carbon atoms, resulting in a chemically modified coating external surface; and the exposing steps are carried out such that: i) each of said modified surfaces has a contact resistance of about 50 mΩ or less; and ii) the resistance of the first plurality of articles to corrosion is increased, as compared to a second plurality of articles nominally identical to the first plurality but not exposed to such a liquid solution.

15. A method for manufacturing a first plurality of metal-coated articles, wherein:

each of said articles has a chemically modified external surface and a contact resistance associated with the external surface;

associated with the coatings is a resistance to corrosion defined as the expected fraction of articles exhibiting contact resistances below a predetermined threshold after being subjected to a predetermined aging process;

the method comprises the steps of:

a) providing a first plurality of metal workpieces, each workpiece comprising a metal substrate and, formed on the substrate, a metal coating which has an external surface, wherein the metal coating comprises a transition metal selected from the group consisting of nickel, cobalt, titanium, chromium, and iron; and b) exposing each of said coating external surfaces to a liquid solution of a monoester of phosphoric acid or of a salt of such monoester, resulting in a chemically modified coating external surface;

the monoester belongs to the group which consists of the phosphatidic acids having the general formula $$\begin{array}{l} H_2O_3POCH_2CH{-}OC(O)(CH_2)_nCH_3 \\ \qquad\qquad\quad | \\ \qquad\qquad CH_2{-}OC(O)(CH_2)_nCH_3, \end{array}$$

wherein n is an integer in the range 10–16; and the exposing step is carried out such that: i) each of said modified surfaces has a contact resistance of about 50 mΩ or less; and ii) the resistance of the first plurality of articles to corrosion is increased, as compared to a second plurality of articles nominally identical to the first plurality but not exposed to such a liquid solution.

16. The method of claim 15, further comprising, before the monoester-exposing step, the step of exposing each said surface to a chromate solution such that the resistance to corrosion is further increased.

17. A method for lubricating a surface of a body which comprises a transition metal, transition metal alloy, or aluminum-containing alloy, the method comprising the step of applying to the surface a liquid solution which comprises a chemical compound having the formula $$CF_3(CF_2)_m(CH_2)_nPO(OH)_2,$$

wherein m equals 5, 7, 9, or 11, and n equals 0, 1, or 2.

* * * * *